US011556072B1

(12) United States Patent
Saeki

(10) Patent No.: US 11,556,072 B1
(45) Date of Patent: Jan. 17, 2023

(54) IMAGE FORMING APPARATUS

(71) Applicant: FUJIFILM Business Innovation Corp., Tokyo (JP)

(72) Inventor: Takashi Saeki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/586,114

(22) Filed: Jan. 27, 2022

(30) Foreign Application Priority Data

Aug. 25, 2021 (JP) ..... JP2021-137631

(51) Int. Cl.

| | |
|---|---|
| ***G03G 15/01*** | (2006.01) |
| ***G03G 15/16*** | (2006.01) |
| ***G03G 15/00*** | (2006.01) |
| ***G03G 15/20*** | (2006.01) |

(52) U.S. Cl.
CPC ..... *G03G 15/0131* (2013.01); *G03G 15/167* (2013.01); *G03G 15/1615* (2013.01); *G03G 15/1685* (2013.01); *G03G 15/2017* (2013.01); *G03G 15/2028* (2013.01); *G03G 15/5008* (2013.01); *G03G 15/657* (2013.01)

(58) Field of Classification Search
CPC ..... G03G 15/0131; G03G 15/1615; G03G 15/167; G03G 15/1685; G03G 15/2017; G03G 15/2028; G03G 15/5008; G03G 15/657
See application file for complete search history.

(56) References Cited

U.S. PATENT DOCUMENTS 5,045,892 A * 9/1991 Morisawa ..... B82Y 15/00 271/248
2011/0044731 A1* 2/2011 Nomura ..... G03G 15/1615 399/302
2021/0294246 A1 9/2021 Yoshioka et al.
2022/0107592 A1* 4/2022 Yuasa ..... G03G 15/167

FOREIGN PATENT DOCUMENTS

JP 2020-140062 A 9/2020

* cited by examiner

*Primary Examiner* — Joseph S Wong
(74) *Attorney, Agent, or Firm* — Sughrue Mion, PLLC

(57) ABSTRACT

An image forming apparatus includes: a rotatable transfer cylinder with a first groove formed in an outer portion thereof in a rotational radial direction that causes an image to be transferred to a recording medium when it passes along an outer surface of the transfer cylinder; a rotatable fixing cylinder that has a second groove formed in an outer portion thereof in a rotational radial direction, that causes the image transferred to the recording medium to be fixed thereto when the recording medium passes along an outer surface of the fixing cylinder; a loop-shaped circulating member that is wrapped at least around the transfer and fixing cylinders, that circulates in response to rotations of the transfer and fixing cylinders; a recording medium holding member supported by the circulating member, disposed in the first groove when the holding member passes along the transfer cylinder and disposed in the second groove when the holding member passes along the fixing cylinder; first and second driving units that rotate the transfer and fixing cylinders respectively; and that is configured such that a ratio of a moment of inertia of the fixing cylinder to an output torque of the second driving unit is set to be greater than a ratio of a moment of inertia of the transfer cylinder to an output torque of the first driving unit.

20 Claims, 5 Drawing Sheets

IMAGE FORMING APPARATUS

CROSS-REFERENCE TO RELATED APPLICATIONS

This application is based on and claims priority under 35 USC 119 from Japanese Patent Application No. 2021-137631 filed Aug. 25, 2021.

BACKGROUND

(i) Technical Field

The present disclosure relates to an image forming apparatus.

(ii) Related Art

Japanese Unexamined Patent Application Publication No. 2020-140062 discloses an image forming apparatus. The image forming apparatus according to this documents includes a loop-shaped transfer belt having an outer surface to which an image is transferred, and a transfer unit including a transfer cylinder and rotating bodies. The transfer cylinder has a transfer area in which a recording medium is sandwiched between the transfer cylinder and the outer surface of the transfer belt to transfer the image from the transfer belt to the recording medium. The rotating bodies are disposed at both ends of the transfer cylinder in an axial direction. The image forming apparatus also includes circulating members wrapped around the rotating bodies and circulated by rotation of the rotating bodies, and a holding unit attached to the circulating members. The holding unit holds the recording medium so that the recording medium is transported by circulation of the circulating members and caused to pass through the transfer area.

SUMMARY

When vibration generated at a fixing cylinder is transmitted to a transfer cylinder during transferring of an image to a recording medium, the image transferred to the recording medium may be degraded.

Aspects of non-limiting embodiments of the present disclosure relate to an image forming apparatus that enables transferring of an image to a recording medium with less degradation of the image compared to when the ratio of a moment of inertia of a fixing cylinder to an output torque of a second driving unit is equal to the ratio of a moment of inertia of a transfer cylinder to an output torque of a first driving unit.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including: a transfer cylinder that is rotatably supported, that has a first groove formed in an outer portion thereof in a rotational radial direction thereof, and that causes an image to be transferred to a recording medium when the recording medium passes along an outer surface of the transfer cylinder in the rotational radial direction; a fixing cylinder that is rotatably supported, that has a second groove formed in an outer portion thereof in a rotational radial direction thereof, and that causes the image transferred to the recording medium to be fixed to the recording medium when the recording medium passes along an outer surface of the fixing cylinder in the rotational radial direction; a circulating member that is loop-shaped, that is wrapped at least around the transfer cylinder and the fixing cylinder, and that circulates in response to rotations of the transfer cylinder and the fixing cylinder; a holding member that is supported by the circulating member, that is configured to hold the recording medium, and that is disposed in the first groove when the holding member passes along the outer portion of the transfer cylinder and disposed in the second groove when the holding member passes along the outer portion of the fixing cylinder; a first driving unit that rotates the transfer cylinder; and a second driving unit that rotates the fixing cylinder and that is configured such that a ratio of a moment of inertia of the fixing cylinder to an output torque of the second driving unit is set to be greater than a ratio of a moment of inertia of the transfer cylinder to an output torque of the first driving unit.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will now be described with reference to the drawings.

Image Forming Apparatus 10

Figure 1:
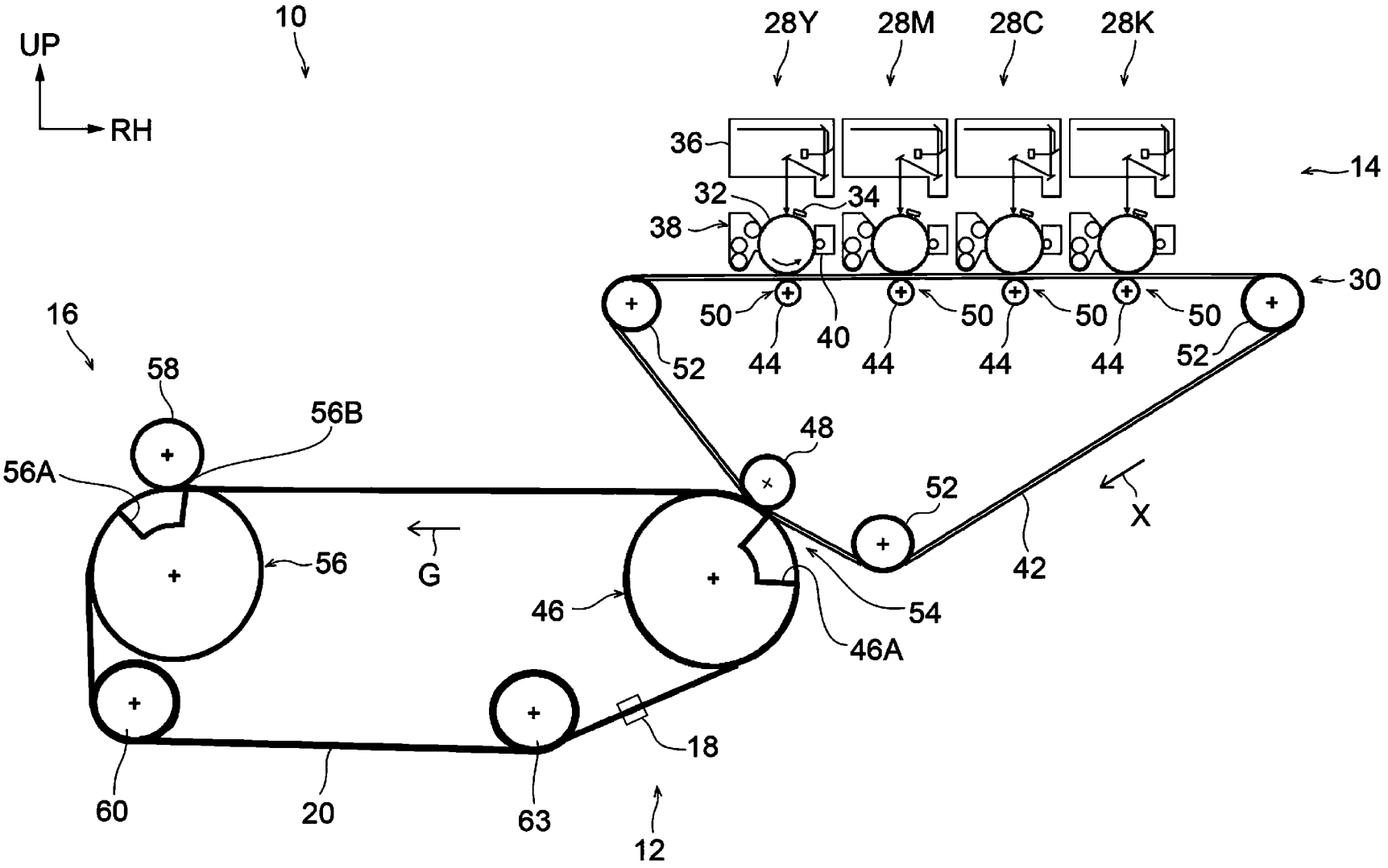
FIG. 1 is a schematic front view illustrating the structure of an image forming apparatus.

The structure of an image forming apparatus 10 will now be described. FIG. 1 is a schematic front view illustrating the structure of the image forming apparatus 10 according to the present exemplary embodiment. In each of the figures, arrow UP shows a vertically upward direction, which is an upward direction with respect the apparatus. Referring to FIG. 1, arrow RH shows a horizontal direction toward the right when viewed from a point facing the front of the apparatus. In the following description, the term "up-down direction" means the up-down direction with respect to the apparatus illustrated in FIG. 1 unless otherwise specifically stated. In addition, the term "left-right direction" means the left-right direction when viewed from a point facing the front of the apparatus illustrated in FIG. 1 unless otherwise specifically stated. In addition, the term "front-back direction" means the front-back direction when viewed from a point facing the front of the apparatus illustrated in FIG. 1 (in other words, near-far direction orthogonal to the plane of FIG. 1) unless otherwise specifically stated.

The image forming apparatus 10 is an electrophotographic image forming apparatus that forms toner images on paper sheets. The paper sheets are an example of a recording medium, and the toner images are an example of an image. More specifically, the image forming apparatus 10 includes a transport unit 12, an image forming unit 14, and a fixing unit 16.

Transport Unit 12

The transport unit 12 has a function of transporting each paper sheet. More specifically, the transport unit 12 includes a gripper 18 and a pair of chains 20. The gripper 18 holds a leading end portion of the paper sheet in a direction in which the paper sheet is transported. The gripper 18 is an example of a holding member. The pair of chains 20 are examples of a circulating member, and are loop-shaped. The pair of chains 20 are arranged in the front-back direction with an interval therebetween. FIG. 1 illustrates one of the pair of chains 20 that is disposed at the front. In FIG. 1, the chain 20 and the gripper 18 are simplified.

Each of the pair of chains 20 is arranged to extend around a transfer cylinder 46, a fixing cylinder 56, a first intermediate shaft portion 60, and a second intermediate shaft portion 63 described below. More specifically, the pair of chains 20 are wrapped around pairs of sprockets (not illustrated) disposed at one and the other ends of each of the transfer cylinder 46, the fixing cylinder 56, the first intermediate shaft portion 60, and the second intermediate shaft portion 63 described below in an axial direction. Accordingly, the transfer cylinder 46, the fixing cylinder 56, the first intermediate shaft portion 60, and the second intermediate shaft portion 63 rotate in synchronization with each other.

In the transport unit 12, the gripper 18 holds the leading end portion of the paper sheet fed from a storage unit (not illustrated). In addition, in the transport unit 12, the chains 20 are circulated in the direction of arrow G while the leading end portion of the paper sheet is held by the gripper 18, so that the paper sheet is transported and caused to pass through an opposing position 54 (or a second transfer position) described below. In addition, in the transport unit 12, the gripper 18 transports the paper sheet that has passed through the opposing position 54 (or the second transfer position) to the fixing unit 16.

Image Forming Unit 14

The image forming unit 14 has a function of forming an image on each paper sheet. More specifically, the image forming unit 14 includes plural toner image forming units 28 that form toner images by an electrophotographic system and a transfer unit 30 that transfers the toner images formed by the toner image forming units 28 to the paper sheet.

Toner Image Forming Units 28

The toner image forming units 28 are provided to form toner images of respective colors. In the present exemplary embodiment, four toner image forming units 28 of respective colors, which are yellow (Y), magenta (M), cyan (C), and black (K), are provided. In FIG. 1, the letters Y, M, C, and K represent the respective colors. The toner image forming units 28 of the respective colors have similar structures except for the toners used therein. Therefore, in FIG. 1, only components of the toner image forming unit 28Y, which serves as a representative one of the toner image forming units 28 of the respective colors, are denoted by reference numerals.

Each of the toner image forming units 28 of the respective colors includes a cylindrical photoconductor 32 that rotates and a charging device 34 that charges the photoconductor 32. Each toner image forming unit 28 further includes an exposure unit 36 that irradiates the charged photoconductor 32 with light for exposure to form an electrostatic latent image, and a developing unit 38 that develops the electrostatic latent image into an image formed of a toner layer by using developer containing toner. Each toner image forming unit 28 further includes a cleaner 40 that removes the toner that remains on the surface of the photoconductor 32 after transferring of the toner from the photoconductor 32 to the transfer belt 42.

Transfer Unit 30

The transfer unit 30 has a function of transferring the toner images on the photoconductors 32 of the respective colors to a transfer belt 42 in a superposed manner by rotating the photoconductors 32 on the transfer belt 42 in a first transfer process, and then transferring the superposed toner images to the paper sheet in a second transfer process. More specifically, the transfer unit 30 includes the transfer belt 42 that serves as an intermediate transfer body, first transfer rollers 44, the transfer cylinder 46, and a second transfer roller 48 (example of a transfer roller).

The first transfer rollers 44 have a function of transferring the toner images formed on the photoconductors 32 to an outer peripheral surface of the transfer belt 42 at first transfer positions 50 between the photoconductors 32 and the first transfer rollers 44.

The transfer belt 42 has an endless shape (or a loop shape), and is wrapped around the second transfer roller 48 and plural rollers 52 so that the transfer belt 42 is supported by the second transfer roller 48 and the rollers 52 in a predetermined position. When at least one of the rollers 52 is rotated, the transfer belt 42 is circulated in the direction of arrow X and transports the images that have been transferred thereto in the first transfer process to the opposing position 54.

The transfer cylinder 46 has a function of transferring the toner images that have been transferred to the transfer belt 42 to the paper sheet in cooperation with the transfer roller 48. The transfer cylinder 46 is disposed at a lower left position with respect to the transfer belt 42 so that the transfer cylinder 46 faces the transfer belt 42. The transfer cylinder 46 has a cylindrical shape with an axis thereof extending in the front-back direction. The transfer cylinder 46 rotates together with sprockets (not illustrated) around which the chains 20 are wrapped. The transfer cylinder 46 has a recessed groove 46A (example of a first groove) for preventing interference with each gripper 18 in an outer peripheral portion thereof, which is an outer portion thereof in the rotational radial direction. When each gripper 18 passes between the transfer cylinder 46 and the second transfer roller 48, the gripper 18 is disposed in the recessed groove 46A.

The second transfer roller 48 opposes the transfer cylinder 46 at the predetermined opposing position 54 with the transfer belt 42 disposed between the second transfer roller 48 and the transfer cylinder 46. More specifically, the second transfer roller 48 is disposed at an upper right position with respect to the transfer cylinder 46.

In the transfer unit 30, each paper sheet transported by the gripper 18 and the chains 20 is nipped between the transfer belt 42 and the transfer cylinder 46 at the opposing position 54, and a second transfer bias is applied between the transfer cylinder 46 and the second transfer roller 48 to generate an electrostatic force that causes the toner images that have been transferred to the outer peripheral surface of the transfer belt 42 to be transferred to the paper sheet. Thus, the opposing position 54 may also be referred to as a second transfer position at which the tone images are transferred in the second transfer process. The opposing position 54 may also be referred to as an image formation position at which an image is formed on the paper sheet. Furthermore, the opposing position 54 may also be referred to as a nipping position (or a nipping region) at which the paper sheet is nipped between the transfer belt 42 (or the second transfer roller 48) and the transfer cylinder 46. Furthermore, the opposing position 54 may also be referred to as a contact position (or a contact region) at which the second transfer roller 48 and the transfer belt 42 are in contact with each other.

Fixing Unit 16

The fixing unit 16 illustrated in FIG. 1 has a function of fixing the image on the paper sheet to the paper sheet. More specifically, the fixing unit 16 includes the fixing cylinder 56 and a pressure roller 58. The pressure roller 58 is an example of a pressure unit. In the fixing unit 16, the image that has been transferred to the paper sheet is fixed to the paper sheet by heat and pressure applied between the pressure roller 58 and the fixing cylinder 56.

The fixing cylinder 56 has a cylindrical shape with an axis thereof extending in the front-back direction. The fixing cylinder 56 has an outer diameter that is equal to the outer diameter of the transfer cylinder 46 within a predetermined tolerance. The fixing cylinder 56 is disposed to the left of the transfer cylinder 46 and at the same position as the transfer cylinder 46 in the up-down direction within a predetermined tolerance. The fixing cylinder 56 rotates together with sprockets (not illustrated) around which the chains 20 are wrapped. The number of teeth on these sprockets is equal to the number of teeth on the sprockets that rotate together with the transfer cylinder 46. The fixing cylinder 56 has a recessed groove 56A (example of a second groove) for preventing interference with each gripper 18 in an outer peripheral portion thereof, which is an outer portion thereof in the rotational radial direction. In the present exemplary embodiment, the dimensions of each portion of the recessed groove 56A are equal to the dimensions of each portion of the recessed groove 46A in the transfer cylinder 46 within a predetermined tolerance. When each gripper 18 passes between the fixing cylinder 56 and the pressure roller 58, the gripper 18 is disposed in the recessed groove 56A.

In the present exemplary embodiment, a mechanism is provided for separating the pressure roller 58 from the fixing cylinder 56 when the recessed groove 56A in the fixing cylinder 56 passes through a region below the pressure roller 58 and moving the pressure roller 58 toward the fixing cylinder 56 (returning the pressure roller 58 to the original position) when the recessed groove 56A in the fixing cylinder 56 leaves the region below the pressure roller 58. This mechanism may be omitted.

In the fixing unit 16, the paper sheet transported by the gripper 18 and the chains 20 is nipped between the fixing cylinder 56 and the pressure roller 58, so that the image that has been transferred to the paper sheet is fixed to the paper sheet. Thus, the position at which the paper sheet is nipped between the fixing cylinder 56 and the pressure roller 58 may also be referred to as a fixing position at which the image is fixed. This position may also be referred to as a nipping position (or a nipping region) at which the paper sheet is nipped between the pressure roller 58 and the fixing cylinder 56. Furthermore, this position may also be referred to as a contact position (or a contact region) at which the pressure roller 58 and the fixing cylinder 56 are in contact with each other.

In the present exemplary embodiment, a first intermediate shaft portion 60 and a second intermediate shaft portion 63 are further provided. Each chain 20 is wrapped around the first intermediate shaft portion 60 and the second intermediate shaft portion 63 in a region that is rotationally upstream of the transfer cylinder 46 and rotationally downstream of the fixing cylinder 56. The first intermediate shaft portion 60 and the second intermediate shaft portion 63 are examples of an inner intermediate shaft portion.

The first intermediate shaft portion 60 and the second intermediate shaft portion 63 are supported rotatably about respective axes extending the front-back direction. The first intermediate shaft portion 60 and the second intermediate shaft portion 63 each include a pair of sprockets around which the pair of chains 20 are wrapped, a shaft member that connects the pair of sprockets in the axial direction, and a flywheel fixed to the shaft member.

In the present exemplary embodiment, the first intermediate shaft portion 60 is disposed below the fixing cylinder 56. Each chain 20 is wrapped around the first intermediate shaft portion 60 such that the first intermediate shaft portion 60 is disposed inside the chain 20. The second intermediate shaft portion 63 is disposed to the right of the first intermediate shaft portion 60 and to the left of the transfer cylinder 46. Each chain 20 is wrapped around the second intermediate shaft portion 63 such that the second intermediate shaft portion 63 is disposed inside the chain 20.

Structure for Reducing Degradation of Transferred Images

The structure of a relevant part of the present exemplary embodiment will now be described.

Figure 2:
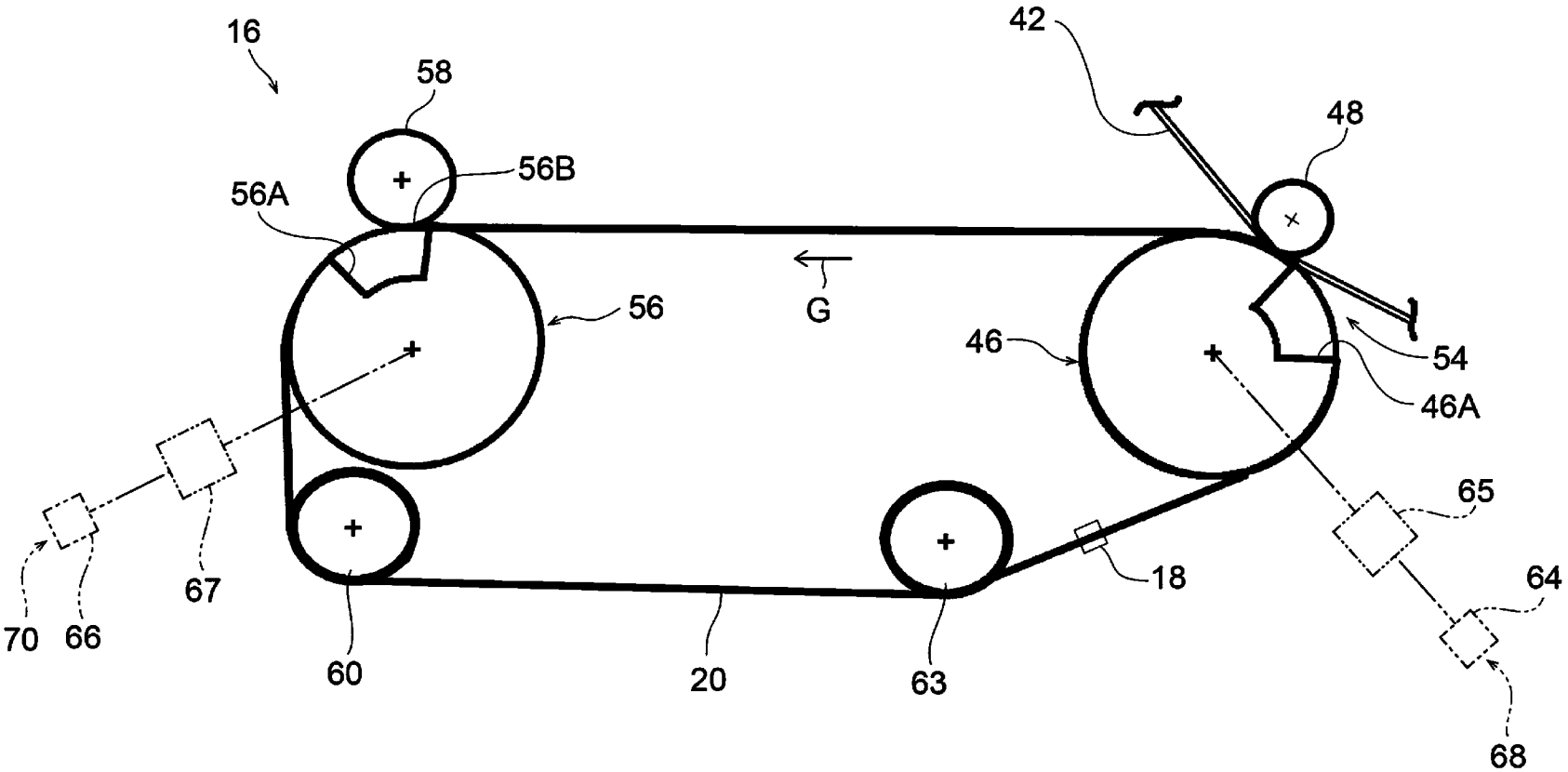
FIG. 2 is an enlarged front view of a part of the image forming apparatus illustrated in FIG. 1.

When an end portion of the recessed groove 56A in the fixing cylinder 56 in a rotation direction of the fixing cylinder 56 comes into contact with the pressure roller 58 as illustrated in FIG. 2, the speed (number of rotation) of the fixing cylinder 56 varies. The speed (number of rotation) of the fixing cylinder 56 particularly varies when a rotationally upstream end portion 56B of the recessed groove 56A in the fixing cylinder 56 comes into contact with the pressure roller 58. When the speed (number of rotation) of the fixing cylinder 56 varies, the speeds (numbers of rotation) of the transfer cylinder 46 and the photoconductors 32 also vary. In the present exemplary embodiment, variations in the speeds of the transfer cylinder 46 and the photoconductors 32 are reduced to reduce degradation of the image transferred to the paper sheet and the toner images transferred to the transfer belt 42. The structure for reducing variations in the speeds of the transfer cylinder 46 and the photoconductors 32 will now be described.

As illustrated in FIG. 2, in the present exemplary embodiment, a first motor 64 that rotates the transfer cylinder 46 and a second motor 66 that rotates the fixing cylinder 56 are provided. The first motor 64 and the second motor 66 are, for example, alternating current (AC) servo motors. Rotation of the first motor 64 is slowed down and transmitted to the transfer cylinder 46 by a first speed reducer 65. Rotation of the second motor 66 is slowed down and transmitted to the fixing cylinder 56 by a second speed reducer 67. The first motor 64 and the first speed reducer 65 that slows down the rotation of the first motor 64 and transmits the rotation to the transfer cylinder 46 form a first driving unit 68 that rotates the transfer cylinder 46. The second motor 66 and the second speed reducer 67 that slows down the rotation of the second motor 66 and transmits the rotation to the fixing cylinder 56 form a second driving unit 70 that rotates the fixing cylinder 56.

In the present exemplary embodiment, the first motor 64 of the first driving unit 68 and the second motor 66 of the second driving unit 70 have, for example, the same rated output of 1500 W. In addition, the first speed reducer 65 of the first driving unit 68 and the second speed reducer 67 of the second driving unit 70 have, for example, the same speed reduction ratio of 40. Accordingly, the rotation of the first motor 64 is transmitted to the transfer cylinder 46 after the speed (rotational speed) thereof is reduced to 1/40 by the first speed reducer 65, and the rotation of the second motor 66 is transmitted to the fixing cylinder 56 after the speed (rotational speed) thereof is reduced to 1/40 by the second speed reducer 67.

The rotation of the first motor 64 and the rotation of the second motor 66 are controlled independently of each other. The rotation of the first motor 64 is detected by an encoder (not illustrated). The rotation of the first motor 64 is controlled so that the rotation detected by the encoder approaches a target. Similarly, the rotation of the second motor 66 is detected by an encoder (not illustrated). The rotation of the second motor 66 is controlled so that the rotation detected by the encoder approaches a target.

In addition, in the present exemplary embodiment, the volume of hollow spaces in the fixing cylinder 56, the mass of a flywheel of the fixing cylinder 56, the volume of hollow spaces in the transfer cylinder 46, the mass of a flywheel of the transfer cylinder 46, etc., are adjusted so that the moment of inertia of the fixing cylinder 56 is greater than the moment of inertia of the transfer cylinder 46. Accordingly, the ratio of the moment of inertia of the fixing cylinder 56 to the output torque of the second driving unit 70 is greater than the ratio of the moment of inertia of the transfer cylinder 46 to the output torque of the first driving unit 68. More specifically, assuming that T2 is the output torque (rated torque) of the second driving unit 70, I2 is the moment of inertia of the fixing cylinder 56 about the rotational axis, T1 is the output torque (rated torque) of the first driving unit 68, and I1 is the moment of inertia of the transfer cylinder 46 about the rotational axis, the following Expression 1 is satisfied.

$$(I2/T2)>(I1/T1) \qquad \text{Expression 1}$$

The rated torque is a driving torque obtained when a rated output is obtained after rotation at a rated voltage and a rated frequency is stabilized. Therefore, when the second driving unit 70 is driven at a rated voltage and a rated frequency, the output torque of the second driving unit 70 is the rated torque. When the second driving unit 70 is driven at a voltage and a frequency different from the rated voltage and the rated frequency, respectively, the output torque obtained after the rotation at that voltage and frequency is stabilized is the output torque of the second driving unit 70.

In addition, in the present exemplary embodiment, the mass of the fixing cylinder 56 is greater than the mass of the transfer cylinder 46. Accordingly, the ratio of the mass of the fixing cylinder 56 to the output torque of the second driving unit 70 is greater than the ratio of the mass of the transfer cylinder 46 to the output torque of the first driving unit 68. In other words, assuming that M2 is the mass of the transfer cylinder 46 and M1 is the mass of the transfer cylinder 46, Expression 2 given below is satisfied. When the dimensions of each component of the fixing cylinder 56 are equal to the dimensions of each component of the transfer cylinder 46 within predetermined tolerances, Expression 2 is satisfied if Expression 1 is satisfied. Similarly, Expression 1 is satisfied if Expression 2 is satisfied.

$$(M2/T2)>(M1/T1) \qquad \text{Expression 2}$$

For example, the mass M1 of the transfer cylinder 46 may be set to 30 kg or less, and the mass M2 of the fixing cylinder 56 may be set to 50 kg or more. Also, the mass M1 of the transfer cylinder 46 may be set to 20 kg or less, and the mass M2 of the fixing cylinder 56 may be set to 60 kg or more.

Referring to FIG. 1, in the present exemplary embodiment, a mass M3 of each photoconductor 32 is set to be less than the mass M2 of the fixing cylinder 56. In addition, in the present exemplary embodiment, the mass M3 of each photoconductor 32 is set to be less than the mass M1 of the transfer cylinder 46. In other words, in the present exemplary embodiment, the following Expression 3 is satisfied.

$$M2>M1>M3 \qquad \text{Expression 3}$$

Operation of Present Exemplary Embodiment

An operation of the present exemplary embodiment will now be described.

In the above-described image forming apparatus 10 of the present exemplary embodiment, the moment of inertia I2 of the fixing cylinder 56 is set to be greater than the moment of inertia I1 of the transfer cylinder 46, so that the ratio of the moment of inertia I2 of the fixing cylinder 56 to the output torque T2 of the second driving unit 70 is greater than the ratio of the moment of inertia I1 of the transfer cylinder 46 to the output torque T1 of the first driving unit 68. In other words, Expression 1 is satisfied. Accordingly, even when vibration generated at the fixing cylinder 56 is transmitted to the transfer cylinder 46 through the chains 20 and the speed of the transfer cylinder 46 varies, the speed of the transfer cylinder 46 may be caused to return to the predetermined speed by the second driving unit 70 more quickly than when the moment of inertia I2 of the fixing cylinder 56 and the moment of inertia I1 of the transfer cylinder 46 are set to be equal. Accordingly, variation in the speed of the transfer cylinder 46 may be reduced.

The ratio of the moment of inertia of the fixing cylinder 56 to the output torque of the second driving unit 70 may instead be set to be greater than the ratio of the moment of inertia of the transfer cylinder 46 to the output torque of the first driving unit 68 by setting the rated output of the first motor 64 to be higher than the rated output of the second motor 66 or by setting the speed reduction ratio of the first speed reducer 65 to be greater than the speed reduction ratio of the second speed reducer 67. In such a case, even when there is no difference in moment of inertia between the fixing cylinder 56 and the transfer cylinder 46 or when the moment of inertia of the fixing cylinder 56 is less than the moment of inertia of the transfer cylinder 46, the number of rotation of the transfer cylinder 46 may be caused to quickly return to the predetermined number of rotation. In other words, variation in the speed of the transfer cylinder 46 may be reduced. Even when the mass of the fixing cylinder 56 is less than the mass of the transfer cylinder 46, the moment of inertia of the fixing cylinder 56 may be set to be greater than the moment of inertia of the transfer cylinder 46 by forming parts where mass is concentrated on outer or inner peripheral portions of the fixing cylinder 56 and the transfer cylinder 46.

Figure 3:
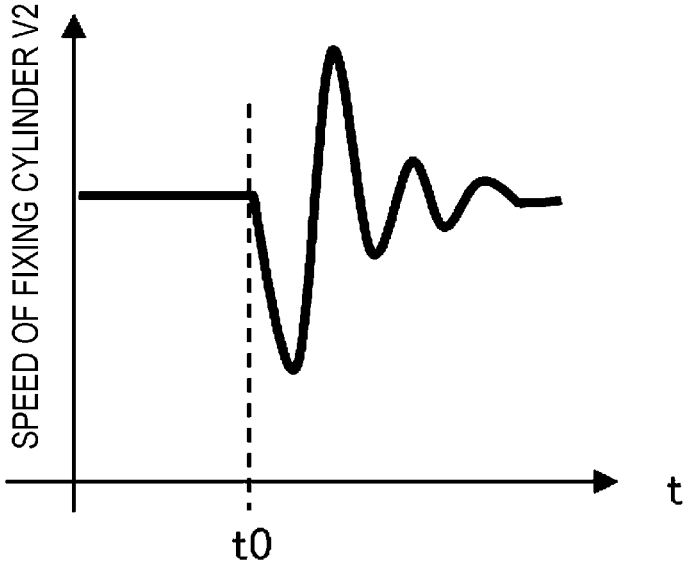
FIG. 3 RELATED ART
FIG. 3 is a graph showing variation in the speed of a fixing cylinder when the fixing cylinder is light relative to a transfer cylinder.
Figure 4:
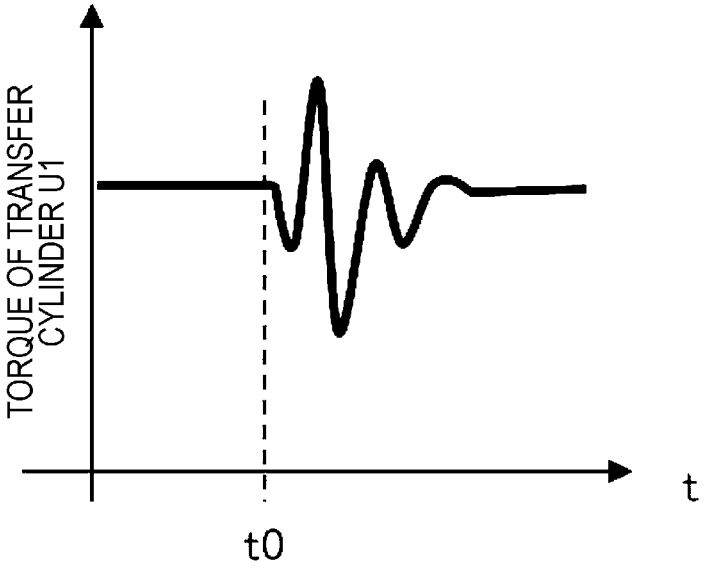
FIG. 4 RELATED ART
FIG. 4 is a graph showing variation in the torque of the transfer cylinder when the fixing cylinder is light relative to the transfer cylinder.

FIGS. 3 and 4 are graphs of a structure including a fixing cylinder 56 according to a comparative example having a mass M2' and a transfer cylinder 46 according to a comparative example having a mass M1'. The mass M2' is less than the mass M2 of the fixing cylinder 56 according to the present exemplary embodiment. The mass M1' is greater than the mass M1 of the transfer cylinder 46 according to the present exemplary embodiment and equal to the mass M2'. In the graph of FIG. 3, the vertical axis represents the speed V2 of the fixing cylinder 56 according to the comparative example having the mass M2', and the horizontal axis represents the time t. Time t0 is the time at which the rotationally upstream end portion 56B of the recessed groove 56A in the fixing cylinder 56 comes into contact with the pressure roller 58. The graph shows that the speed V2 of the fixing cylinder 56 varies after time t0.

In the graph of FIG. 4, the vertical axis represents the torque U1 of the transfer cylinder 46 according to the comparative example having the mass M1', and the horizontal axis represents the time t. The graph shows that the torque U1 of the transfer cylinder 46 varies after time t0.

As is clear from FIGS. 3 and 4, the torque T1 of the transfer cylinder 46 starts to vary substantially immediately when the rotationally upstream end portion 56B of the recessed groove 56A in the fixing cylinder 56 comes into contact with the pressure roller 58.

Figure 5:
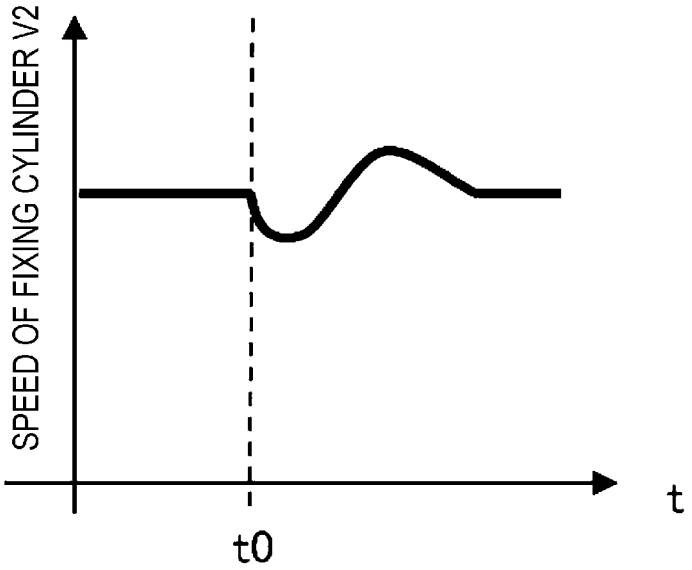
FIG. 5 is a graph showing variation in the speed of the fixing cylinder when the fixing cylinder is heavy relative to the transfer cylinder.
Figure 6:
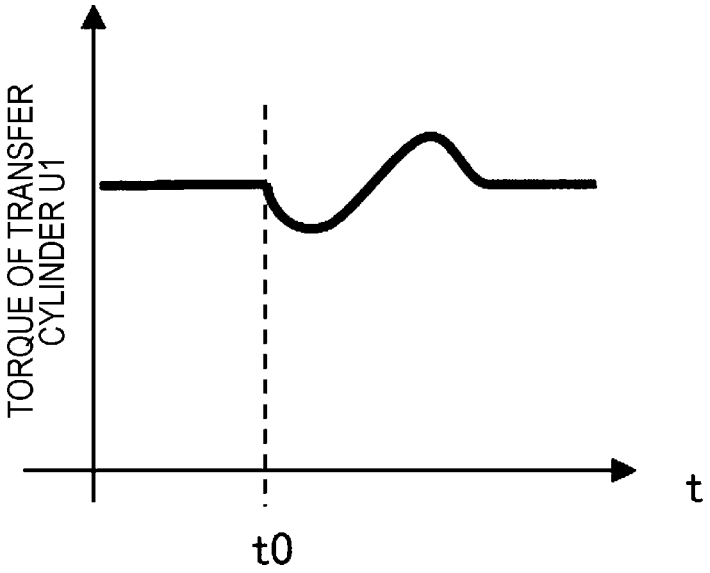
FIG. 6 is a graph showing variation in the torque of the transfer cylinder when the fixing cylinder is heavy relative to the transfer cylinder.

FIGS. 5 and 6 are graphs of a structure including the fixing cylinder 56 according to the present exemplary embodiment having the mass M2 and the transfer cylinder 46 according to the present exemplary embodiment having the mass M1. In the graph of FIG. 5, the vertical axis represents the speed V2 of the fixing cylinder 56 according to the present exemplary embodiment having the mass M2, and the horizontal axis represents the time t. The graph shows that although the speed V2 of the fixing cylinder 56 varies after time t0, the range of variation is less than that under the conditions of FIG. 3. This is because the mass of the fixing cylinder is changed from M2' to M2.

In the graph of FIG. 6, the vertical axis represents the torque U1 of the transfer cylinder 46 according to the present exemplary embodiment having the mass M1, and the horizontal axis represents the time t. The graph shows that although the torque U1 of the transfer cylinder 46 varies after time t0, the range of variation is less than that under the conditions of FIG. 3. This is because the mass of the fixing cylinder is changed from M2' to M2.

As is clear from FIGS. 5 and 6, the range of variation in the torque U1 of the transfer cylinder 46 may be reduced from that under the conditions of FIG. 3 by increasing the mass of the fixing cylinder 56 from that under the conditions of FIG. 3 so that the mass of the fixing cylinder 56 is greater than the mass of the transfer cylinder 46.

Figure 7:
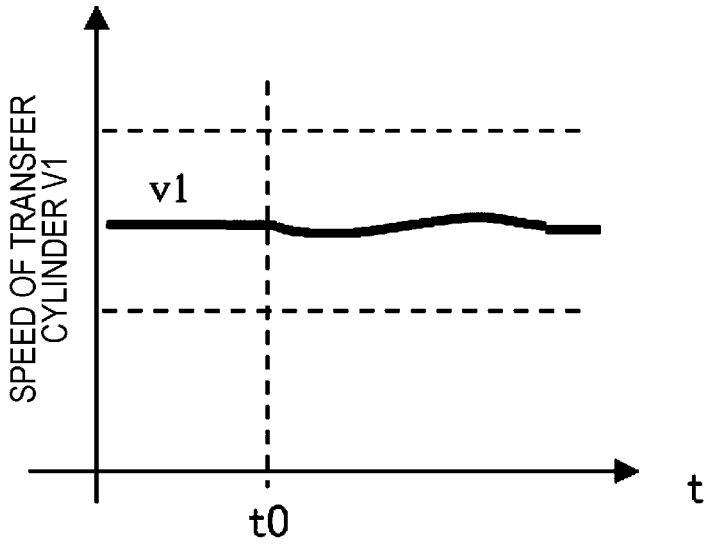
FIG. 7 is a graph showing variation in the speed of the transfer cylinder when the fixing cylinder is heavy relative to the transfer cylinder.
Figure 8:
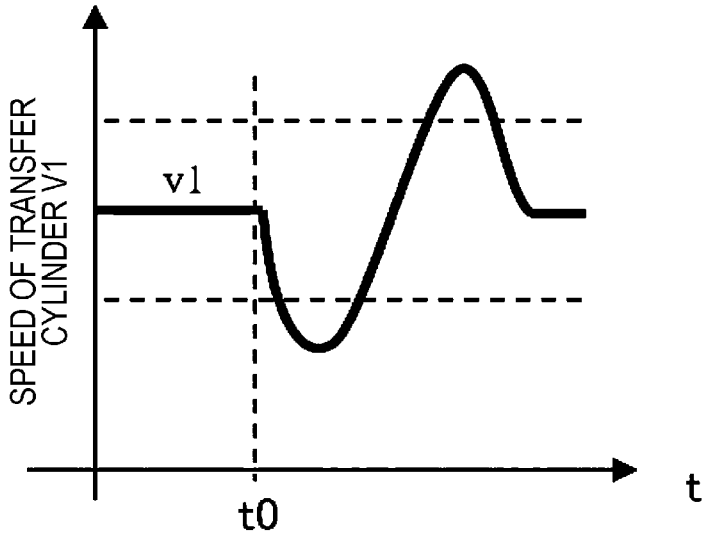
FIG. 8 RELATED ART
FIG. 8 is a graph showing variation in the speed of the transfer cylinder when the fixing cylinder is light relative to the transfer cylinder.

FIG. 7 is a graph of a structure including the fixing cylinder 56 according to the present exemplary embodiment having the mass M2 and the transfer cylinder 46 according to the present exemplary embodiment having the mass M1. In the graph, the vertical axis represents the speed V1 of the transfer cylinder 46 and the horizontal axis represents the time t. FIG. 8 is a graph of a structure including the fixing cylinder 56 according to the present exemplary embodiment having the mass M2 and the transfer cylinder 46 according to the comparative example having the mass M1'. In the graph, the vertical axis represents the speed V1 of the transfer cylinder 46 and the horizontal axis represents the time t. These graphs show the manner in which the speed of the transfer cylinder 46 varies from the predetermined speed v1 and then returns to the predetermined speed v1. As is clear from these graphs, under the conditions of FIG. 7, the speed of the transfer cylinder 46 varies from the predetermined speed v1 by a smaller amount after time t0 and more quickly returns to the speed v1 than under the conditions of FIG. 8.

Referring to FIG. 1, in the present exemplary embodiment, the mass M3 of each photoconductor 32 is set to be less than the mass M2 of the fixing cylinder 56. Accordingly, variation in the speed of each photoconductor 32 caused by variation in the speed of the fixing cylinder 56 may be reduced compared to when the mass M3 of each photoconductor 32 is equal to or greater than the mass M2 of the fixing cylinder 56. In addition, in the present exemplary embodiment, the mass M3 of each photoconductor 32 is set to be less than the mass M1 of the transfer cylinder 46. Accordingly, variation in the speed of each photoconductor 32 caused by variation in the speed of the transfer cylinder 46 may be reduced compared to when the mass M3 of each photoconductor 32 is equal to or greater than the mass M1 of the transfer cylinder 46.

The above-described structures may be applied in combinations as appropriate. In addition, components of the image forming apparatus 10 may be replaced by other components having similar functions.

Although an exemplary embodiment of the present disclosure is described above, the present disclosure is not limited to the above description, and various other modifications are, of course, possible without departing from the spirit of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a transfer cylinder that is rotatably supported, that has a first groove formed in an outer portion thereof in a rotational radial direction thereof, and that causes an image to be transferred to a recording medium when the recording medium passes along an outer surface of the transfer cylinder in the rotational radial direction;

a fixing cylinder that is rotatably supported, that has a second groove formed in an outer portion thereof in a rotational radial direction thereof, and that causes the image transferred to the recording medium to be fixed to the recording medium when the recording medium passes along an outer surface of the fixing cylinder in the rotational radial direction;

a circulating member that is loop-shaped, that is wrapped at least around the transfer cylinder and the fixing cylinder, and that circulates in response to rotations of the transfer cylinder and the fixing cylinder;

a holding member that is supported by the circulating member, that is configured to hold the recording medium, and that is disposed in the first groove when the holding member passes along the outer portion of the transfer cylinder and disposed in the second groove when the holding member passes along the outer portion of the fixing cylinder;

a first driving unit that rotates the transfer cylinder; and a second driving unit that rotates the fixing cylinder and that is configured such that a ratio of a moment of inertia of the fixing cylinder to an output torque of the second driving unit is set to be greater than a ratio of a moment of inertia of the transfer cylinder to an output torque of the first driving unit.

2. The image forming apparatus according to claim 1, wherein the moment of inertia of the fixing cylinder is set to be greater than the moment of inertia of the transfer cylinder.

3. An image forming apparatus comprising:

a transfer cylinder that is rotatably supported, that has a first groove formed in an outer portion thereof in a rotational radial direction thereof, and that causes an image to be transferred to a recording medium when the recording medium passes along an outer surface of the transfer cylinder in the rotational radial direction;

a fixing cylinder that is rotatably supported, that has a second groove formed in an outer portion thereof in a rotational radial direction thereof, and that causes the image transferred to the recording medium to be fixed to the recording medium when the recording medium passes along an outer surface of the fixing cylinder in the rotational radial direction, the fixing cylinder having a mass greater than a mass of the transfer cylinder;

a circulating member that is loop-shaped, that is wrapped at least around the transfer cylinder and the fixing cylinder, and that circulates in response to rotations of the transfer cylinder and the fixing cylinder;

a holding member that is supported by the circulating member, that is configured to hold the recording medium, and that is disposed in the first groove when the holding member passes along the outer portion of the transfer cylinder and disposed in the second groove when the holding member passes along the outer portion of the fixing cylinder;

a first driving unit that rotates the transfer cylinder; and a second driving unit that rotates the fixing cylinder.

4. The image forming apparatus according to claim 3, wherein the mass of the transfer cylinder is 30 kg or less, and the mass of the fixing cylinder is 50 kg or more.

5. The image forming apparatus according to claim 4, wherein the mass of the transfer cylinder is 20 kg or less, and the mass of the fixing cylinder is 60 kg or more.

6. The image forming apparatus according to claim 1, further comprising:

a photoconductor that is rotatably supported and that causes a toner image to be formed on an outer surface thereof in a rotational radial direction thereof; and a transfer belt that is loop-shaped, that is circulated in one direction, and that causes the toner image to be transferred thereto when the photoconductor rotates on an outer peripheral surface thereof, wherein a mass of the photoconductor is set to be less than a mass of the fixing cylinder.

7. The image forming apparatus according to claim 2, further comprising:

a photoconductor that is rotatably supported and that causes a toner image to be formed on an outer surface thereof in a rotational radial direction thereof; and a transfer belt that is loop-shaped, that is circulated in one direction, and that causes the toner image to be transferred thereto when the photoconductor rotates on an outer peripheral surface thereof, wherein a mass of the photoconductor is set to be less than a mass of the fixing cylinder.

8. The image forming apparatus according to claim 3, further comprising:

a photoconductor that is rotatably supported and that causes a toner image to be formed on an outer surface thereof in a rotational radial direction thereof; and a transfer belt that is loop-shaped, that is circulated in one direction, and that causes the toner image to be transferred thereto when the photoconductor rotates on an outer peripheral surface thereof, wherein a mass of the photoconductor is set to be less than the mass of the fixing cylinder.

9. The image forming apparatus according to claim 4, further comprising:

a photoconductor that is rotatably supported and that causes a toner image to be formed on an outer surface thereof in a rotational radial direction thereof; and a transfer belt that is loop-shaped, that is circulated in one direction, and that causes the toner image to be transferred thereto when the photoconductor rotates on an outer peripheral surface thereof, wherein a mass of the photoconductor is set to be less than the mass of the fixing cylinder.

10. The image forming apparatus according to claim 5, further comprising:

a photoconductor that is rotatably supported and that causes a toner image to be formed on an outer surface thereof in a rotational radial direction thereof; and a transfer belt that is loop-shaped, that is circulated in one direction, and that causes the toner image to be transferred thereto when the photoconductor rotates on an outer peripheral surface thereof, wherein a mass of the photoconductor is set to be less than the mass of the fixing cylinder.

11. The image forming apparatus according to claim 6, wherein the mass of the photoconductor is less than a mass of the transfer cylinder.

12. The image forming apparatus according to claim 7, wherein the mass of the photoconductor is less than a mass of the transfer cylinder.

13. The image forming apparatus according to claim 8, wherein the mass of the photoconductor is less than the mass of the transfer cylinder.

14. The image forming apparatus according to claim 9, wherein the mass of the photoconductor is less than the mass of the transfer cylinder.

15. The image forming apparatus according to claim 10, wherein the mass of the photoconductor is less than the mass of the transfer cylinder.

16. The image forming apparatus according to claim 1, wherein a rated output of the first driving unit is equal to a rated output of the second driving unit.

17. The image forming apparatus according to claim 2, wherein a rated output of the first driving unit is equal to a rated output of the second driving unit.

18. The image forming apparatus according to claim 3, wherein a rated output of the first driving unit is equal to a rated output of the second driving unit.

19. The image forming apparatus according to claim 4, wherein a rated output of the first driving unit is equal to a rated output of the second driving unit.

20. The image forming apparatus according to claim 1, wherein a ratio of a mass of the fixing cylinder to the output torque of the second driving unit is set to be greater than a ratio of a mass of the transfer cylinder to the output torque of the first driving unit.

* * * * *